US008325113B2

(12) United States Patent
Kim et al.

(10) Patent No.: US 8,325,113 B2
(45) Date of Patent: Dec. 4, 2012

(54) ORGANIC ELECTROLUMINESCENT DISPLAY DEVICE AND DRIVING METHOD OF THE SAME

(75) Inventors: Jin-Hyoung Kim, Goyang-si (KR); Won-Kyu Ha, Gumi-si (KR); Hak-Su Kim, Seoul (KR); Su-Jin Baek, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 852 days.

(21) Appl. No.: 12/340,122

(22) Filed: Dec. 19, 2008

(65) Prior Publication Data

US 2009/0273546 A1 Nov. 5, 2009

(51) Int. Cl.
*G09G 3/30* (2006.01)
*G09G 3/10* (2006.01)

(52) U.S. Cl. ..... 345/76; 315/169.3

(58) Field of Classification Search ..... 345/90–92, 345/76–77; 315/169.1–169.3
See application file for complete search history.

(56) References Cited

U.S. PATENT DOCUMENTS

| | | | | |
|---|---|---|---|---|
| 2005/0017929 | A1* | 1/2005 | Sano et al. | 345/76 |
| 2005/0052890 | A1* | 3/2005 | Morita | 365/87 |
| 2006/0176251 | A1* | 8/2006 | Park et al. | 345/76 |
| 2007/0296671 | A1* | 12/2007 | Han et al. | 345/92 |
| 2008/0284691 | A1* | 11/2008 | Chung et al. | 345/76 |

FOREIGN PATENT DOCUMENTS

| | | | |
|---|---|---|---|
| JP | 2006-208966 | | 8/2006 |
| KR | 10-2004-0004783 | | 1/2004 |
| KR | 10-2004-0078324 | | 10/2004 |
| KR | 1020070003575 | * | 1/2007 |
| KR | 10-2008-0085575 | | 9/2008 |
| KR | 10-2008-0099380 | | 11/2008 |

OTHER PUBLICATIONS

"P-14: Polarity-Balanced Driving to Reduce Vth Shift in a-Si for Active-Matrix OLEDs," Bong-Hyun You et al., SID 04 Digest, p. 272-275.

"The Suppression of the Threshold Voltage Shift in a-Si TFT pixel for AMOLED by Employing the Reverse Bias Annealing," Jae-Hoon Lee et al., IDW, '04, p. 541-542.

Office Action issued in corresponding Japanese Patent Application No. JP 2008-320971, dated Aug. 31, 2011.

* cited by examiner

*Primary Examiner* — Joseph Haley
*Assistant Examiner* — Nicholas Lee
(74) *Attorney, Agent, or Firm* — Brinks Hofer Gilson & Lione

(57) ABSTRACT

An organic electroluminescent display device includes a power supply unit outputting a driving voltage, a base voltage and a reference voltage, a source driving unit outputting a data voltage, a gate driving unit outputting a positive scan signal and a negative scan signal, a timing control unit controlling the source driving unit and the gate driving unit, and a display unit receiving the driving voltage, the base voltage, the reference voltage, the positive scan signal and the negative scan signal, the display unit including an organic light-emitting diode that has driving currents depending on the data voltage.

10 Claims, 7 Drawing Sheets

ORGANIC ELECTROLUMINESCENT DISPLAY DEVICE AND DRIVING METHOD OF THE SAME

RELATED APPLICATIONS

This application claims the benefit of Korean Patent Application No. 10-2008-0040472, filed in Korea on Apr. 30, 2008, which is hereby incorporated by reference in its entirety.

BACKGROUND

1. Field of the Disclosure

The present disclosure relates to an organic electroluminescent display device, and more particularly, to an organic electroluminescent display device and a driving method of the same.

2. Discussion of the Related Art

Organic electroluminescent display (OELD) devices have been proposed and developed to solve problems of liquid crystal display (LCD) devices that are not self-luminous. The OELD devices are self-luminous display devices, which emit light by electrically exciting fluorescent organic compounds. The OELD devices can be driven by low voltages and can have relatively a thin thickness. OELD devices including thin film transistors as a switching element in each pixel are be referred to as active matrix OELD (AMOELD) devices.

FIG. 1 is a view of a pixel structure of an organic electroluminescent display device according to a first embodiment of the related art, and FIG. 1 shows a pixel including two transistors and one capacitor.

In FIG. 1, the pixel includes a switching transistor SW, a capacitor C, a driving transistor DR and an organic light-emitting diode OLED. The switching transistor SW and the driving transistor DR are thin film transistors including amorphous silicon (a-Si:H) and are NMOS (n-channel metal-oxide-semiconductor) transistors.

A gate electrode of the switching transistor SW is connected to a scan line S, and a source electrode of the switching transistor SW is connected to a data line D. One electrode of the capacitor C is connected to a drain electrode of the switching transistor SW, and the other electrode of the capacitor C is connected to a base voltage VSS, which may be ground potential. A gate electrode of the driving transistor DR is connected to the drain electrode of the switching transistor SW and the one electrode of the capacitor C, a source electrode of the driving transistor DR is connected to the base voltage VSS, and a drain electrode of the driving transistor DR is connected to a cathode electrode of the organic light-emitting diode OLED. An anode electrode of the organic light-emitting diode OLED is connected to a power supply line VDD providing driving voltages.

A driving method of the organic electroluminescent display device having the pixel structure of FIG. 1 will be explained with reference to FIG. 2. FIG. 2 shows a timing chart of the organic electroluminescent display device of FIG. 1.

The switching transistor SW turns ON by a positive selection voltage VGH, which is supplied to an nth scan line S(n) (n is a natural number) from a gate driving integrated circuit (not shown), and the capacitor C is charged due to a data voltage Vdata supplied to the data line D. The data voltage Vdata is positive because the driving transistor DR has an n-type channel. Intensity of currents flowing through the channel of the driving transistor DR depends on potential difference between the data voltage Vdata stored in the capacitor C and the driving voltage VDD, and the organic light-emitting diode OLED emits light according to the intensity of the currents.

In the two-transistor and one-capacitor pixel structure, to continuously keep the driving transistor DR on after applying the positive data voltage Vdata, the driving transistor DR including amorphous silicon (a-Si:H) receives the positive voltage stored in the capacitor C. This further increases deterioration of the driving transistor DR and causes changes in a threshold voltage and mobility of the driving transistor DR. Accordingly, currents are not stably provided to the organic light-emitting diode OLED, and quality of displayed images are lowered.

To solve the problem, another pixel structure has been suggested.

FIG. 3 is a view of a pixel structure of an organic electroluminescent display device according to a second embodiment of the related art, and FIG. 4 is a timing chart of the organic electroluminescent display device of FIG. 3. FIG. 3 shows a pixel including four transistors and two capacitors, and the pixel of FIG. 3 includes two portions symmetrical to each other, each of which has a two-transistor and one-capacitor (2T-1C) structure of FIG. 1. The transistors of FIG. 3 are NMOS transistors.

Degradation is compensated by applying a negative voltage to a driving transistor of one 2T-1C portion during a driving timing of the other 2T-1C portion, and compensating degradation is alternately performed at each frame.

Referring to FIG. 3 and FIG. 4, one scan timing 1 ST is divided into two parts, and a first scan signal Vg1 and a second scan signal Vg2 are sequentially applied to a first scan line S1 and a second scan line S2.

In an even frame, a data voltage Vdata having a normal level is applied to the pixel through a first switching transistor SW1 and a first driving transistor DR1 during a timing of applying the first scan signal Vg1, and then a data voltage Vdata having a negative voltage value is applied through a second switching transistor SW2 during timings t1 and t2 of applying the second scan signal Vg2, thereby compensating degradation of a second driving transistor DR2.

Similarly, in an odd frame, a data voltage Vdata having a normal level is applied the pixel through the second switching transistor SW2 and the second driving transistor DR2 during a timing of applying the second scan signal Vg2, and then a data voltage Vdata having a negative voltage value is applied through the first switching transistor SW1 during timings t3 and t4 of applying the first scan signal Vg1, thereby compensating degradation of the first driving transistor DR1.

However, the second embodiment of the related art, which alternately compensates degradation of the first and second driving transistors DR1 and DR2 at each frame, requires more transistors and capacitors than the first embodiment of the related art. In addition, the number of scan lines also increases. Moreover, the driving speed should be at least two times faster than the first embodiment of the related art or the number of gate driving ICs should be increased because one scan timing 1ST of FIG. 4 is divided into two parts and two scan signals are applied.

BRIEF SUMMARY

In a first aspect, an organic electroluminescent display device includes a power supply unit outputting a driving voltage, a base voltage and a reference voltage, a source driving unit outputting a data voltage, a gate driving unit outputting a positive scan signal and a negative scan signal, a timing control unit controlling the source driving unit and the gate driving unit, and a display unit receiving the driving voltage, the base voltage, the reference voltage, the positive scan signal and the negative scan signal, the display unit including an organic light-emitting diode that has driving currents depending on the data voltage.

In a second aspect, an organic electroluminescent display device includes a first switching transistor including a gate electrode connected to a scan line and a source electrode connected to a data line, a second switching transistor including a gate electrode connected to a reference voltage and a source electrode connected to the scan line, a driving transistor including a gate electrode connected to drain electrodes of the first and second switching transistors and a source electrode connected to a base voltage, a capacitor connected to the gate electrode of the driving transistor and the base voltage, and an organic light-emitting diode connected to a drain electrode of the driving transistor and a driving voltage.

In a third aspect, a method of driving an organic electroluminescent display device includes applying a positive scan signal to a first switching transistor, applying a data voltage to a driving transistor through the first switching transistor such that the data voltage is synchronized with the positive scan signal, thereby providing driving currents to an organic light-emitting diode, and applying a reference voltage and a negative scan signal to a second switching transistor, thereby providing the negative scan signal to the driving transistor, wherein the reference voltage has a negative voltage value, and the negative scan signal is lower than the reference voltage.

It is to be understood that both the foregoing general description and the following detailed description of the present invention are exemplary and explanatory and are intended to provide further explanation of the invention as claimed. Other systems, methods, features and advantages will be, or will become, apparent to one with skill in the art upon examination of the following figures and detailed description. Nothing in this section should be taken as a limitation on those claims. Further aspects and advantages are discussed below in conjunction with the embodiments. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

The system and/or method may be better understood with reference to the following drawings and description. Non-limiting and non-exhaustive embodiments are described with reference to the following drawings. The components in the figures are not necessarily to scale, emphasis instead being placed upon illustrating the principles of the invention. In the figures, like referenced numerals designate corresponding parts throughout the different views. The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail to an embodiment of the present disclosure, an example of which is illustrated in the accompanying drawings.

Figure 1A:
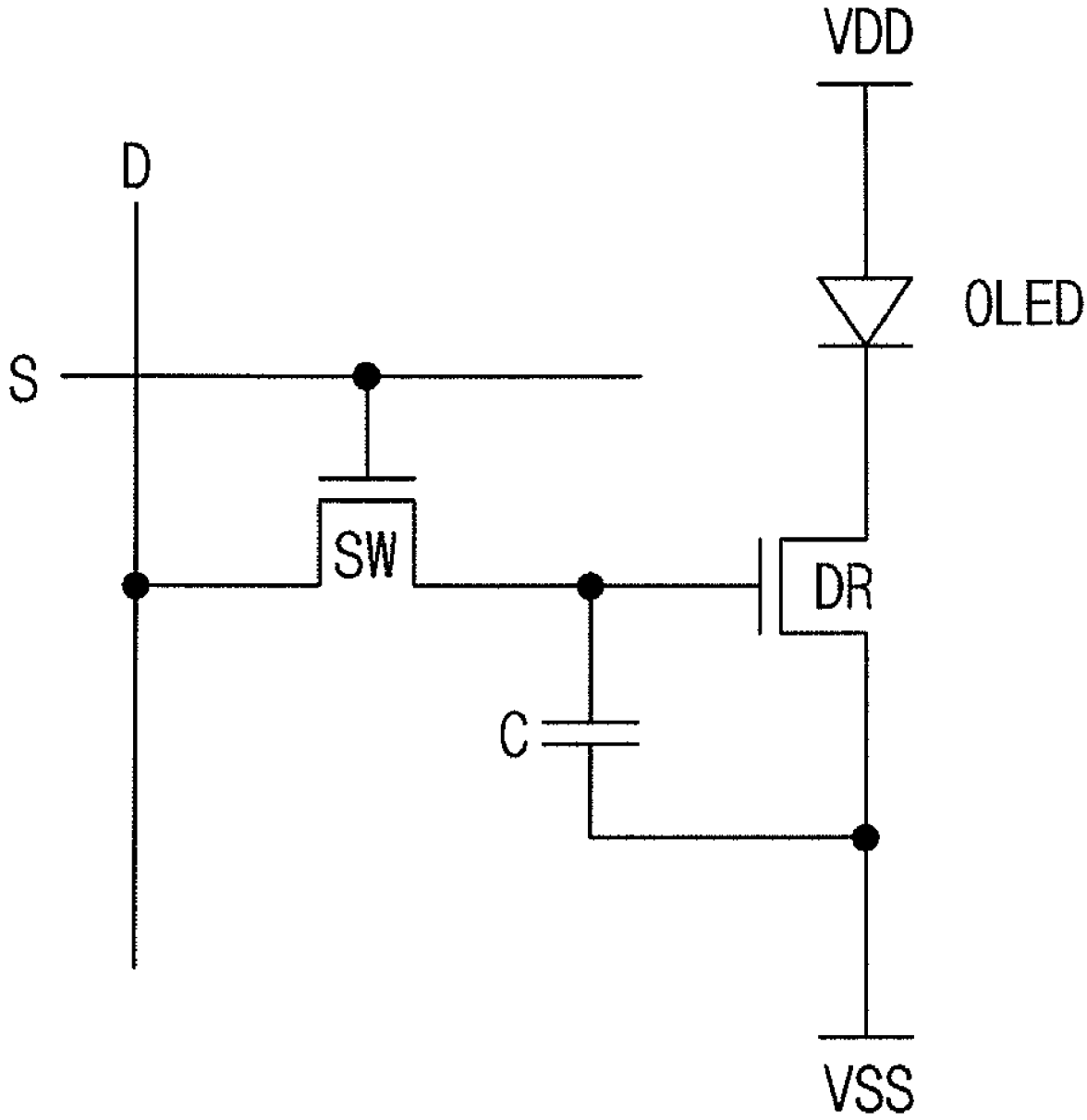
FIG. 1A RELATED ART
FIG. 1 is a view of a pixel structure of an organic electroluminescent display device according to a first embodiment of the related art.
Figure 2:
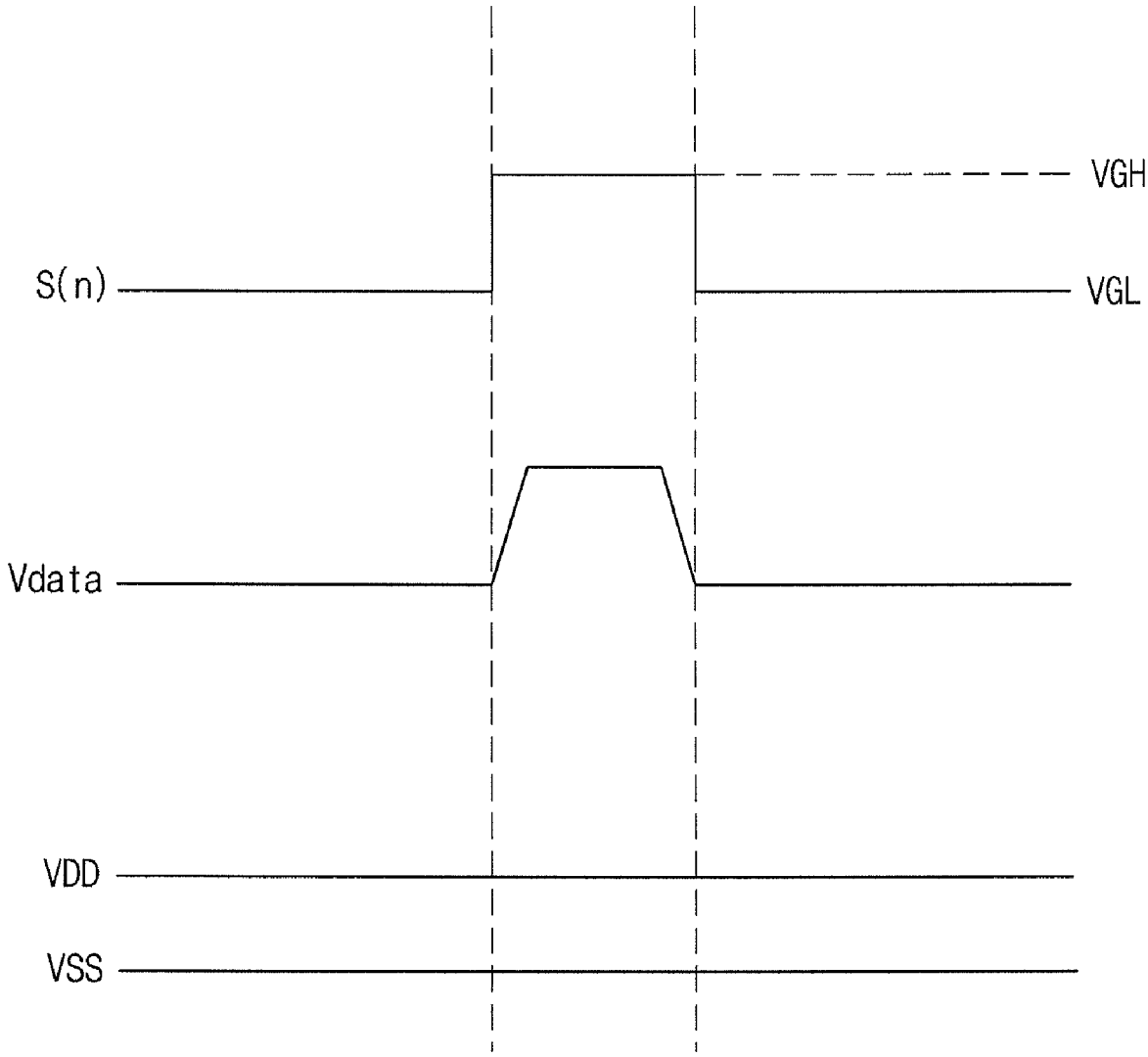
FIG. 2 RELATED ART
FIG. 2 is a timing chart of the organic electroluminescent display device of FIG. 1.
Figure 3:
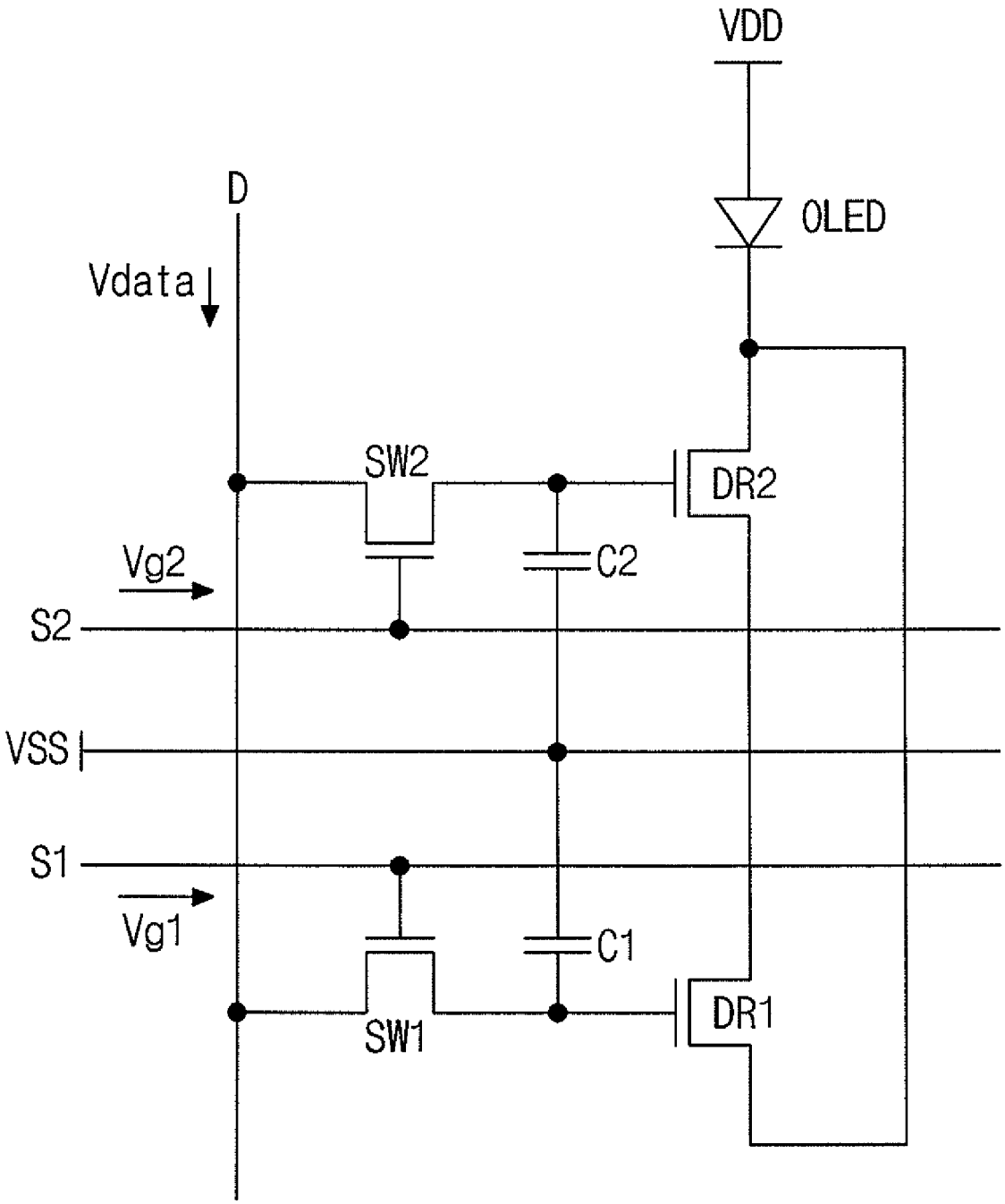
FIG. 3 RELATED ART
FIG. 3 is a view of a pixel structure of an organic electroluminescent display device according to a second embodiment of the related art.
Figure 4:
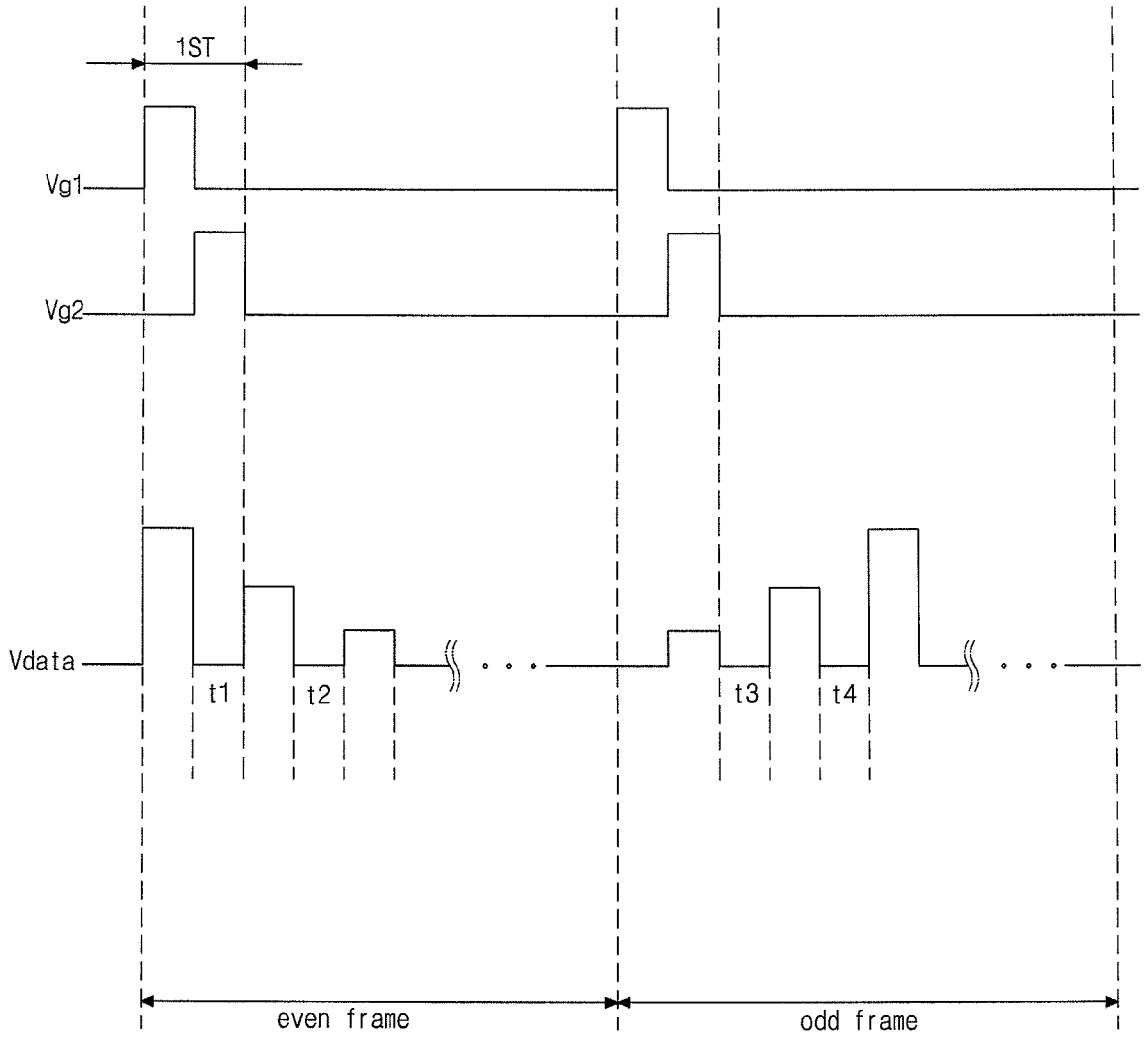
FIG. 4 RELATED ART
FIG. 4 is a timing chart of the organic electroluminescent display device of FIG. 3.
Figure 5:
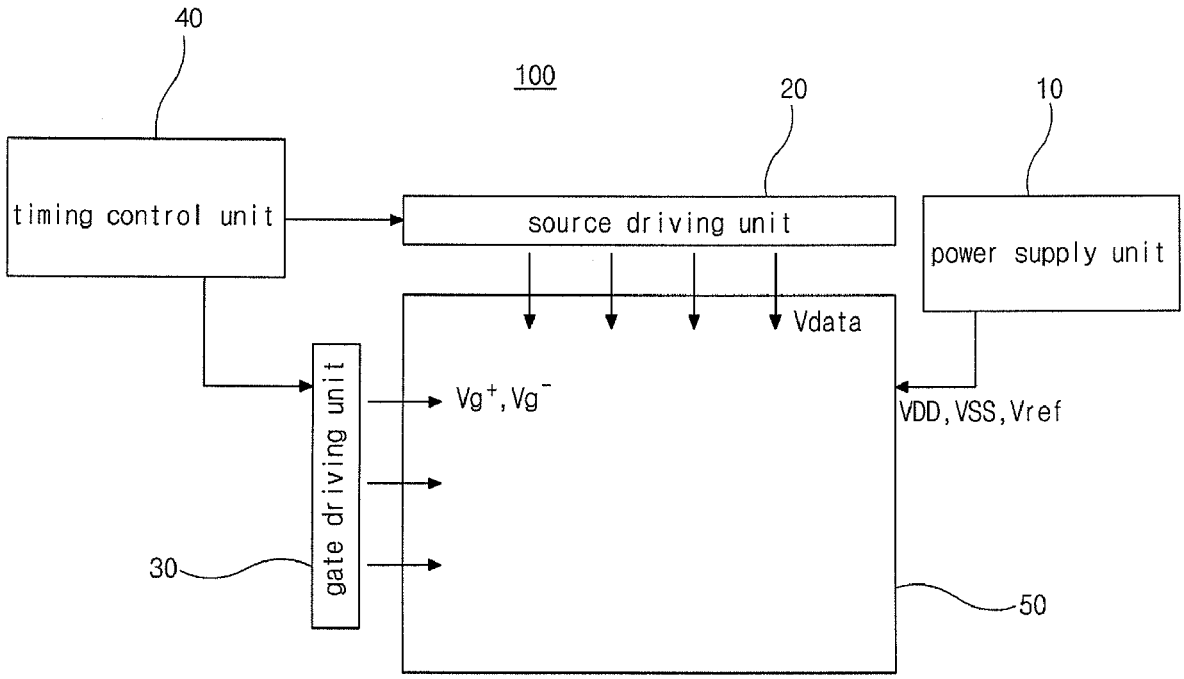
FIG. 5 is a view of schematically illustrating an organic electroluminescent display device according to an exemplary embodiment of the present invention.

FIG. 5 is a view of schematically illustrating an organic electroluminescent display device according to an exemplary embodiment of the present invention.

In FIG. 5, the organic electroluminescent display device 100 includes a power supply unit 10, a source driving unit 20, a gate driving unit 30, a timing control unit 40 and a display unit 50.

The power supply unit 10 generates and provides power sources for the source driving unit 20, the gate driving unit 30, the timing control unit 40 and the display unit 50. Particularly, the power supply unit 10 supplies a driving voltage VDD, a base voltage VSS and a reference voltage Vref for each pixel of the display unit 50.

The source driving unit 20 outputs a data voltage Vdata corresponding to an image data to the display unit 50. The gate driving unit 30 outputs a positive scan signal Vg+ and a negative scan signal Vg− to the display unit 50, and this will be explained in more detail.

The timing control unit 40 provides control signals for controlling the source driving unit 20 and the gate driving unit 30. The timing control unit 40 also supplies the image data to the source driving unit 20.

The display unit 50 includes a plurality of pixels, each of which has an organic light-emitting diode.

Figure 6:
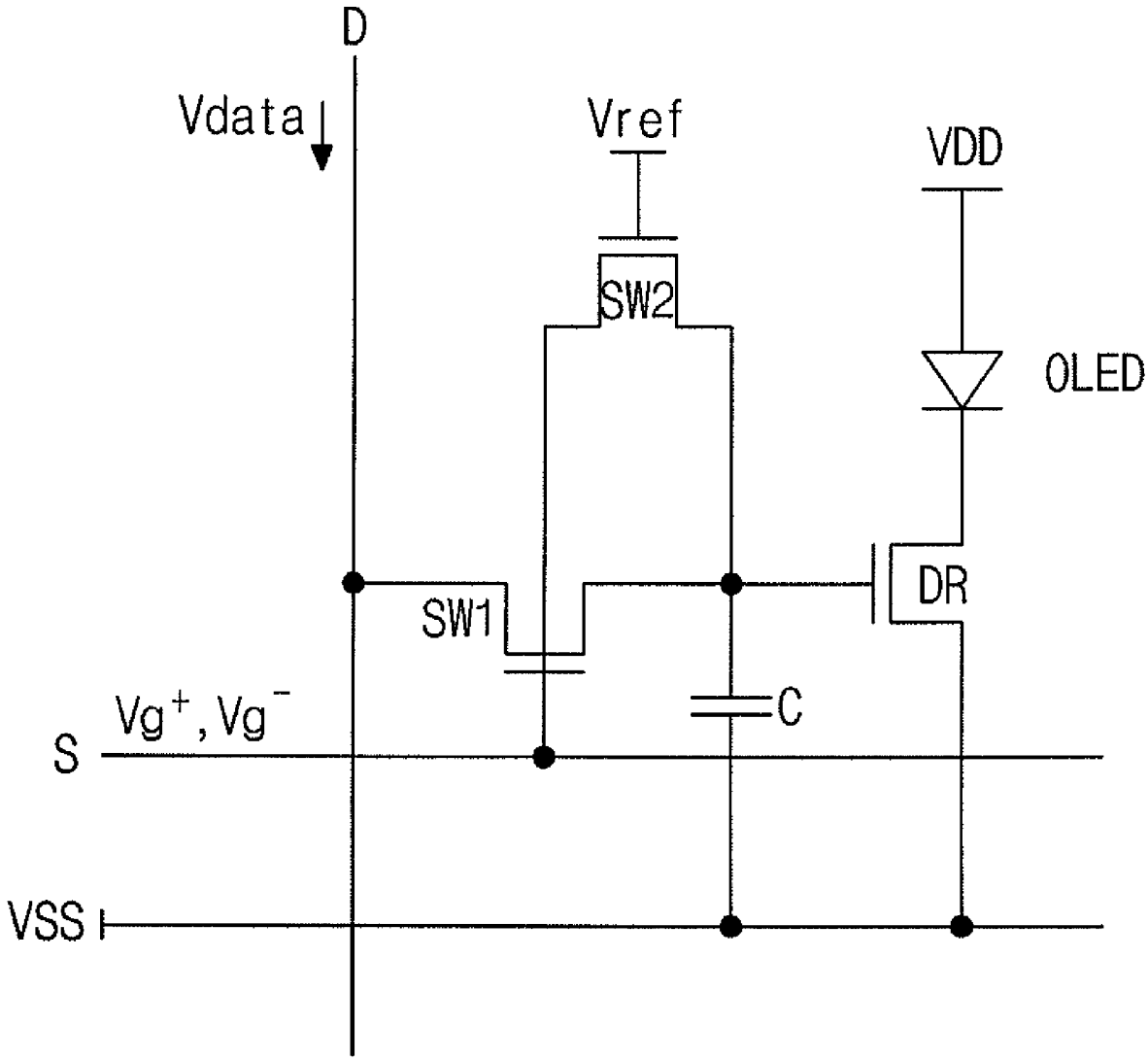
FIG. 6 is a view of a pixel structure of an organic electroluminescent display device according to an exemplary embodiment of the present invention.

The structure of the pixel will be explained in more detail with reference to FIG. 6. Referring to FIG. 6, the pixel includes a first switching transistor SW1, a second switching transistor SW2, a driving transistor DR, a capacitor C and an organic light-emitting diode OLED. The first switching transistor SW1 is connected to a scan line S and a data line D. The first switching transistor SW1 and the second switching transistor SW2, beneficially, are NMOS (n-channel metal-oxide-semiconductor) transistors.

The first switching transistor SW1 receives a data voltage Vdata from the data line D and is switched according to a positive scan signal Vg+ supplied through the scan line S to ouput the data voltage Vdata to the driving transistor DR. The data voltage Vdata is positive because the driving transistor DR is an NMOS transistor. The positive scan signal Vg+ may have a high level voltage Vg+H of about +15V and a low level voltage Vg+L of about −7V. The capacitor C is charged by the data voltage Vdata. Intensity of currents flowing through a channel of the driving transistor DR depends on a potential difference between the voltage charged in the capacitor C and the driving voltage VDD. The organic light-emitting diode OLED emits light according to the intensity of the currents, and the amount of emitted light is determined.

The reference voltage Vref is input to a gate electrode of the second switching transistor SW2, and a negative scan signal Vg− is input to a source electrode of the second switching transistor SW2. At this time, the second switching transistor SW2 is switched according to a potential difference between the reference voltage Vref and the negative scan signal Vg−.

More particularly, since the second switching transistor SW2 is the NMOS transistor, the second switching transistor SW2 is switched on when the negative scan signal Vg− is lower than the reference voltage Vref, and the second switching transistor SW2 is switched off when the negative scan signal Vg− is higher than the reference voltage Vref.

Accordingly, in the present invention, the reference voltage Vref and the high level voltage Vg+H and the low level voltage Vg+L of the positive scan signal Vg+ have the following relation:

$$-[(Vg+H)-(Vg+L)]<V\text{ref}<Vg+L.$$

For example, when the high level voltage Vg+H of the positive scan signal Vg+ is +15V and the low level voltage Vg+L is −7V, the reference voltage Vref is selected within a range of −22V to −7V.

In addition, a range of the negative scan signal Vg− is determined according to selection of the reference voltage Vref. Since the second switching transistor SW2 is the NMOS transistor, a high level voltage Vg−H of the negative scan signal Vg− is higher than the reference voltage Vref, and a low level voltage Vg−L of the negative scan signal Vg− is lower than the reference voltage Vref.

Here, values and applied times of the high level voltage Vg−H and the low level voltage Vg−L of the negative scan signal Vg− directly affect compensating degradation of the driving transistor DR, and the values and times can be variously chosen by a designer. For example, the applied time of the low level voltage Vg−L of the negative scan signal Vg− may be more than 10% of a usual applied time of a scan signal and less than 0.25 seconds.

Operation of the organic electroluminescent display device according to the present invention, particularly, the operation of the display unit 50 of FIG. 5, will be described with reference to the accompanying drawings.

Figure 7:
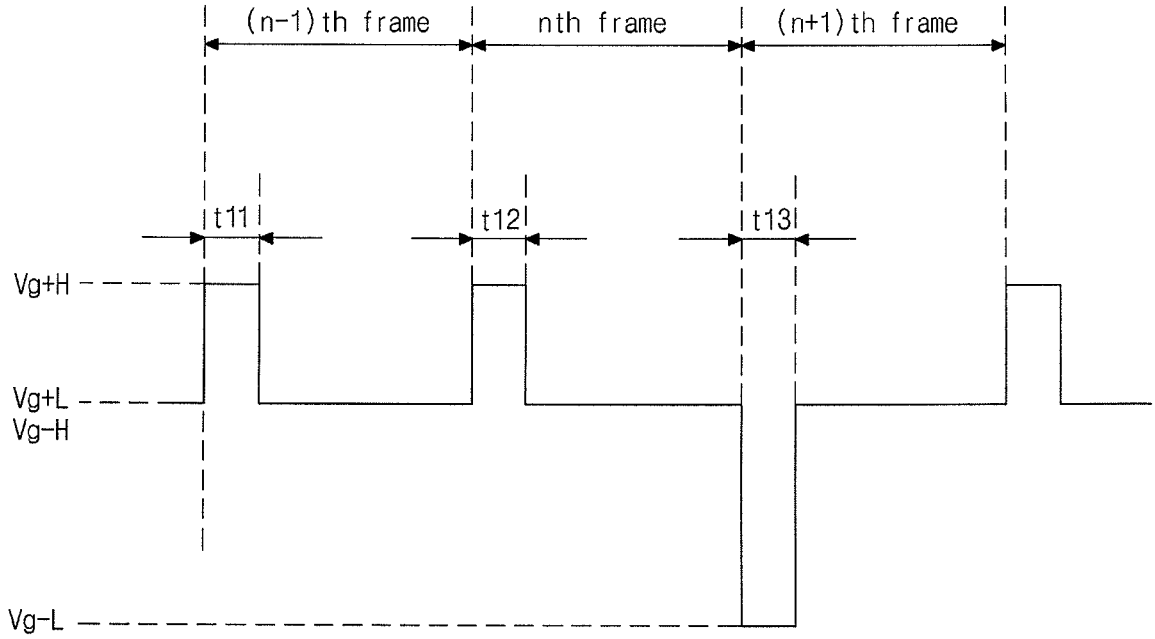
FIG. 7 is a timing chart of a scan signal for an organic electroluminescent display device according to the exemplary embodiment of the present invention.
Figure 8:
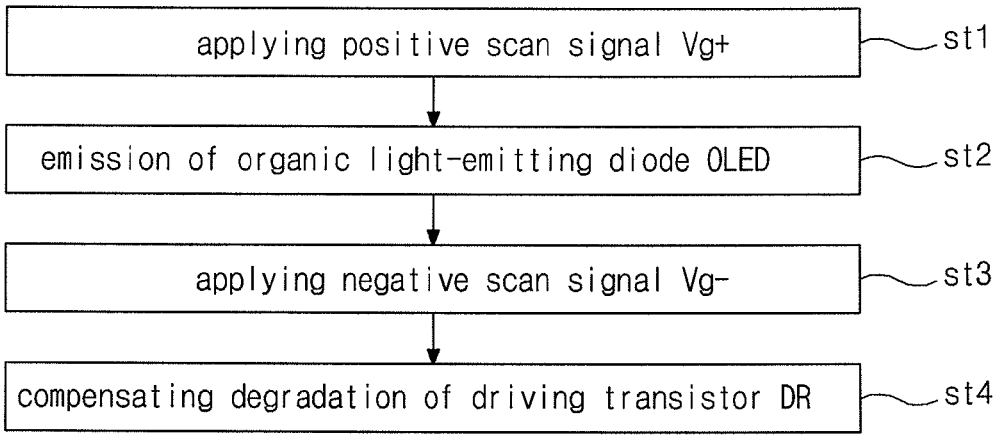
FIG. 8 is a flow chart of showing operation of an organic electroluminescent display device according to the exemplary embodiment of the present invention.

FIG. 7 is a timing chart of a scan signal for an organic electroluminescent display device according to the exemplary embodiment of the present invention, and FIG. 8 is a flow chart of showing operation of an organic electroluminescent display device according to the exemplary embodiment of the present invention.

As shown in FIG. 7, in the organic electroluminescent display device of the present invention, the positive scan signal Vg+ having the high level voltage Vg+H and the low level voltage Vg+L is applied to compensate degradation of the driving transistor DR of FIG. 6, the negative scan signal Vg− of a negative voltage value is periodically applied to the driving transistor DR for a predetermined time. Here, the high level voltage Vg−H of the negative scan signal Vg− may have the same value as the low level voltage Vg+L of the positive scan signal Vg+

Referring to FIG. 8, at first step st1, the gate driving unit 30 applies a positive scan signal Vg+ to the first switching transistor SW1 through the scan line S during scan timings t11 and t12 of (n−1)th frame and nth frame of FIG. 7. At this time, since the first switching transistor SW1 is an NMOS transistor, the positive scan signal Vg+ may have the high level voltage Vg+H of about +15V and the low level voltage Vg+L of about −7V as stated above. Here, the positive scan signal Vg+, which is higher than the reference voltage Vref applied to the gate electrode of the second switching transistor SW2, is applied to the source electrode of the second switching transistor SW2, and thus the second switching transistor SW2 keeps switching off.

Next, at second step st2, the data driving unit 20 of FIG. 5 outputs the data voltage Vdata to the first switching transistor SW1 through the data line D such that the data voltage Vdata is synchronized with the positive scan signal Vg+. When the first switching transistor SW1 switches on, the data voltage Vdata is provided to the driving transistor DR, and the organic light-emitting diode OLED emits light according to the intensity of currents flowing through the channel of the driving transistor DR.

At third step st3, the reference voltage Vref of a negative voltage value is supplied to the gate electrode of the second switching transistor SW2, and the negative scan signal Vg−, which has a lower negative voltage value than the reference voltage Vref, is applied to the source electrode of the second switching transistor SW2 from the gate driving unit 30 during a scan timing t13 of (n+1)th frame of FIG. 7. Therefore, the second switching transistor SW2 switches on, and the negative scan signal Vg− is provided to the driving transistor DR. Here, since the negative scan signal Vg− is applied to the first switching transistor SW1, the first switching transistor keeps switching off.

At fourth step st4, the voltage applied to the gate electrode of the driving transistor DR has a negative voltage value, and thus compensating degradation due to the data voltage Vdata is performed.

Like this, the organic electroluminescent display device normally displays images according to the first step st1 and the second step st2 and compensates degradation of the driving transistor according to the third step st3 and the fourth step st4. At this time, compensating degradation may be performed every other frame or may be performed after displaying images for several frames in accordance with selection of a designer.

In the present invention, degradation of the driving transistor is compensated with a relatively simple pixel structure and low manufacturing costs as compared with the related art.

It will be apparent to those skilled in the art that various modifications and variations can be made in the present invention without departing from the spirit or scope of the invention. The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive. The above disclosed subject matter is to be considered illustrative, and not restrictive, and the appended claims are intended to cover all such modifications, enhancements, and other embodiments, which fall within the true spirit and scope of the present invention.

The invention claimed is:

1. An organic electroluminescent display device, comprising:

a power supply unit that outputs a driving voltage, a base voltage and a reference voltage;

a source driving unit that outputs a data voltage;

a gate driving unit that outputs a positive scan signal and a negative scan signal;

a timing control unit that controls the source driving unit and the gate driving unit; and a display unit that receives the driving voltage, the base voltage, the reference voltage, the positive scan signal and the negative scan signal, the display unit including an organic light-emitting diode that has driving currents depending on the data voltage, wherein the reference voltage is lower than the positive scan signal, and the negative scan signal is lower than the reference voltage, wherein the reference voltage satisfies a relation of $-[(Vg+H)-(Vg+L)]<Vref<Vg+L$, wherein Vref is the reference voltage, Vg+H is a high level voltage of the positive scan signal, and Vg+L is a low level voltage of the positive scan signal.

2. The device according to claim 1, wherein the display unit includes:

a first switching transistor that switches on according to the positive scan signal and outputs the data voltage;

a second switching transistor that switches on according to a voltage difference between the reference voltage and the negative scan signal and outputs the negative scan signal;

a driving transistor that provides the driving currents to the organic light-emitting diode according to the data voltage output from the first switching transistor; and a capacitor that stores the data voltage output from the first switching transistor.

3. The device according to claim 2, wherein the gate driving unit outputs the positive scan signal more frequently than the negative scan signal or alternately outputs the positive scan signal and the negative scan signal.

4. The device according to claim 3, wherein the positive scan signal has a high level voltage of a positive voltage value and a low level voltage of a negative voltage value, and the negative scan signal has a low level voltage of a negative voltage value.

5. The device according to claim 4, wherein the low level voltage of the negative scan signal is lower than the low level voltage of the positive scan signal.

6. The device according to claim 4, wherein the low level voltage of the negative scan signal is lower than the reference voltage.

7. The device according to claim 1, wherein the first switching transistor and the second switching transistor are NMOS transistors.

8. An organic electroluminescent display device, comprising:

a first switching transistor including a gate electrode connected to a scan line and a source electrode connected to a data line;

a second switching transistor including a gate electrode connected to a reference voltage, a drain electrode connected to a drain electrode of the first switching transistor and a source electrode connected to the scan line;

a driving transistor including a gate electrode connected to the drain electrodes of the first and second switching transistors and a source electrode connected to a base voltage;

a capacitor connected to the gate electrode of the driving transistor and the base voltage; and an organic light-emitting diode connected to a drain electrode of the driving transistor and a driving voltage, wherein a positive scan signal and a negative scan signal are provided to the signal line, and a data voltage is provided to the data line, wherein the reference voltage satisfies a relation of $-[(Vg+H)-(Vg+L)]<Vref<Vg+L$, wherein Vref is the reference voltage, Vg+H is a high level voltage of the positive scan signal, and Vg+L is a low level voltage of the positive scan signal.

9. A method of driving an organic electroluminescent display device, comprising applying a positive scan signal to a first switching transistor;

applying a data voltage to a driving transistor through the first switching transistor such that the data voltage is synchronized with the positive scan signal, thereby providing driving currents to an organic light-emitting diode; and applying a reference voltage and a negative scan signal to a second switching transistor, thereby providing the negative scan signal to the driving transistor, wherein the reference voltage has a negative voltage value and is lower than the positive scan signal, and the negative scan signal is lower than the reference voltage, wherein the reference voltage satisfies a relation of $-[(Vg+H)-(Vg+L)]<Vref<Vg+L$, wherein Vref is the reference voltage, Vg+H is a high level voltage of the positive scan signal, and Vg+L is a low level voltage of the positive scan signal.

10. The method according to claim 9, wherein the first switching transistor and the second switching transistor are NMOS transistors.

* * * * *

UNITED STATES PATENT AND TRADEMARK OFFICE

CERTIFICATE OF CORRECTION

PATENT NO. : 8,325,113 B2
APPLICATION NO. : 12/340122
DATED : December 4, 2012
INVENTOR(S) : Jin-Hyoung Kim et al.

It is certified that error appears in the above-identified patent and that said Letters Patent is hereby corrected as shown below:

On the Title Page

Left column, insert a new item as follows:

Item (30) -- Foreign Application Priority Data

April 30, 2008 (KR) 10-2008-0040472 --.

Signed and Sealed this
Thirtieth Day of April, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,325,113 B2
APPLICATION NO. : 12/340122
DATED : December 4, 2012
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 977 days.

Signed and Sealed this
Eleventh Day of November, 2014

Michelle K. Lee

Michelle K. Lee
*Deputy Director of the United States Patent and Trademark Office*